United States Patent [19]

Glore

[11] 4,372,358

[45] Feb. 8, 1983

[54] JOINTER-PLANER IN-FEED TABLE

[75] Inventor: Thomas G. Glore, Easley, S.C.

[73] Assignee: The Singer Company, Stamford, Conn.

[21] Appl. No.: 204,406

[22] Filed: Nov. 6, 1980

[51] Int. Cl.[3] ..... B27C 1/14

[52] U.S. Cl. ..... 144/117 R; 29/436; 29/526 R; 144/129

[58] Field of Search ..... 144/114 R, 117 R, 129; 29/434, 450, 526 R, 436; 83/421

[56] References Cited

U.S. PATENT DOCUMENTS

| | | | |
|---|---|---|---|
| 1,802,096 | 4/1931 | Tautz | 144/117 R |
| 2,099,519 | 11/1937 | Hedgpeth | 144/129 |
| 2,581,475 | 1/1952 | Fenner | 144/117 R |
| 2,837,130 | 6/1958 | Gale | 144/117 R |
| 2,960,125 | 11/1960 | Erickson et al. | 144/129 |

*Primary Examiner*—W. D. Bray

*Attorney, Agent, or Firm*—Robert E. Smith; Edward L. Bell

[57] ABSTRACT

A table support of die-cast and machined generally wedge-shaped configuration is suspended from the machine base by four screws and positioned by four leveling screws adjacent the suspension screws. The table support provides two parallel, spaced apart flat, inclined ramps or ways along which the in-feed table is moved by a height adjustment screw. The in-feed table is also of die-cast and machined generally wedge-shaped configuration and is held to the table support by a pair of extension coil springs having looped ends that are inserted into holes provided in the table and table support castings, respectively, so that the assembly is of generally rectangular block shape of variable height. In assembly, the springs are assembled in a relatively unstressed position and the table and table support moved relative one another by pushing the table up the ramps or ways on the table support to stretch and tension the springs to tighten the table and table support together. A hook on the table rides over a lug on the table support when the springs are stretched to lock the unit or assembly together.

10 Claims, 6 Drawing Figures

JOINTER-PLANER IN-FEED TABLE

DESCRIPTION

FIELD OF THE INVENTION

This invention relates to jointer-planers for use in edging and surface planing materials such as wood, or the like, and, more particularly, to improved in-feed tables therefore.

BACKGROUND OF THE INVENTION

A jointer-planer is a bench or table mounted power tool which can be utilized to smooth rough stock, chamfer decorative edges, square edges on wood stock and joint edges for a tight flush fit, as in laminating boards edge-to-edge for fabricating furniture tops, doors, sides, panels, shelves, and the like. To achieve these functions, the machine generally comprises an elongated generally cylindrical cutter assembly or head that rotates about a generally horizontal axis having one or more, generally a plurality, of peripherally mounted generally linear cutting knives together with an in-feed table adjustable parallel the cutter head axis for supporting the board or other workpiece for feed to the cutter head, and an out-feed table for receiving the board after it has passed the cutter head and had its surface planed thereby. A fence which passes perpendicular the cutter head axis, extending along the edges of the in-feed and out-feed tables, is generally also provided which is adjustable rotatably about a horizontal axis to enable the planed surface to be finished perpendicular another surface or at a desired angle relative thereto. These components are carried by a base assembly which provides rigidity and stability to the tool and carries a drive means for rotating the cutter head at high speed. The present application relates to the in-feed table which, it will be understood, is preferably adjustable so as to enable the depth of cut to be adjusted. At the same time, it is important that, during adjustment, the in-feed table move accurately parallel the cutter axis and the out-feed table. The present invention achieves this adjustability and accuracy inexpensively, by providing an in-feed table assembly comprising few parts, easily assembled and adapted to be adjusted during assembly so as to be parallel the cutter head axis.

OBJECTS OF THE INVENTION

Bearing in mind the foregoing, it is a primary object of the present invention to provide a novel and improved in-feed table assembly or arrangement for a jointer-planer which is inexpensive to produce and assemble and which is yet accurate and easy to adjust.

Another primary object of the present invention, in addition to the foregoing object, is the provision of an in-feed table arrangement for a jointer-planar which comprises a minimal number of components.

Still another primary object of the present invention, in addition to each of the foregoing objects, is the provision of such an in-feed table arrangement for a jointer-planer which essentially comprises two main die-cast components requiring a minimal amount of machining, an elevating screw, and a pair of tension coil springs.

Yet still another primary object of the present invention, in addition to each of the foregoing objects, is the provision of such in-feed table assembly having right angle ways held in abutting contact entirely by springs.

Yet another and still further object of the present invention, in addition to each of the foregoing objects, is the provision of such in-feed assemblies wherein the table support is held to the base by four mounting bolts passing through integrally molded mounting lugs and the requisite parallelism of the in-feed table to the out-feed table and cutter assembly is achieved by adjustable leveling screws threadedly carried by the mounting lugs.

It is yet still another primary object of the present invention, in addition to each of the foregoing objects, to provide novel and improved methods of manufacture, adjustment and assembly of in-feed tables and of jointer-planers incorporating the same.

The invention resides in the combination, construction, arrangement and disposition of the various component parts and elements incorporated in improved in-feed table arrangements and assemblies for jointer-planers, jointer-planers incorporating the same, and methods of manufacture, adjustment and assembly thereof in accordance with the principles of this invention. The present invention will be better understood and objects and important features other than those specifically enumerated above will become apparent when consideration is given to the following details and description which, when taken in conjunction with the annexed drawing, describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

A table support of diecast and machined generally wedge-shaped configuration is suspended from the machine base by four suspension or mounting screws and positioned by four leveling screws adjacent the suspension screws. The table support provides two parallel, spaced apart flat, inclined ramps or ways along which the in-feed table is moved by a height adjustment screw. The in-feed table is also of die-cast and machined generally wedge-shaped configuration and is held to the table support by a pair of extension coil springs having looped ends that are inserted into holes provided in the table and table support castings, respectively, so that the assembly is of generally rectangular block shaped configuration of variable height. In assembly, the springs are assembled in a relatively unstressed position and the table and table support moved relative one another by pushing the table up the ramps or ways on the table support to stretch and tension the springs to tighten the table and table support together. A hook on the table rides over a lug on the table support when the springs are stretched to lock the unit or assembly together.

DETAILED DESCRIPTION OF THE INVENTION

Figure 1:
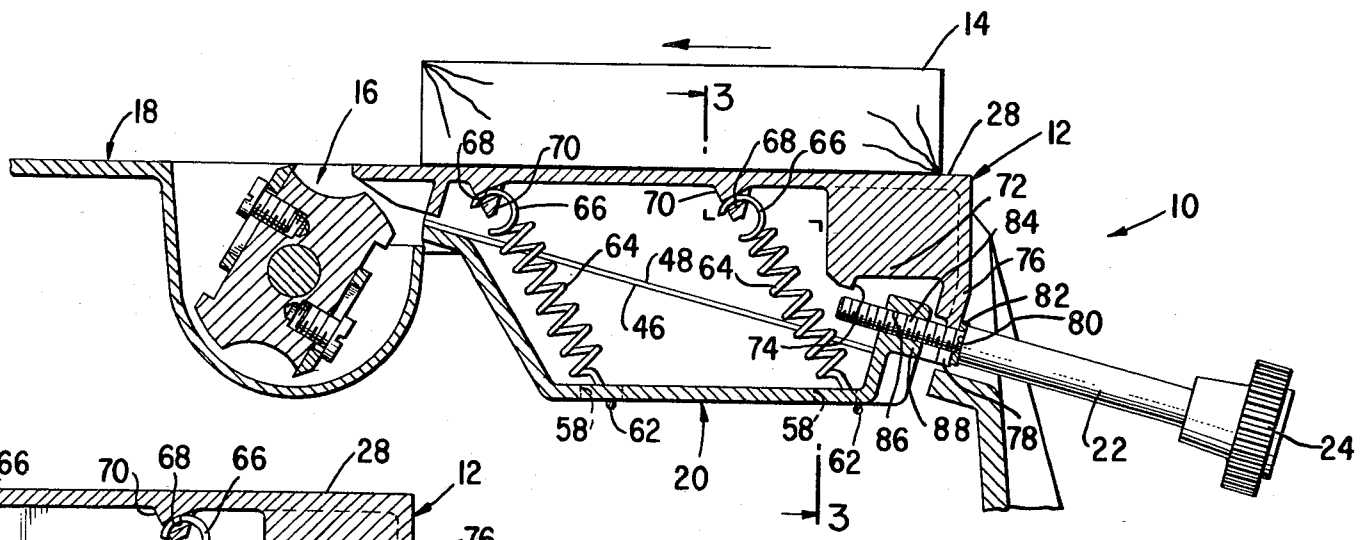
FIG. 1 is an elevational partial view of an in-feed table of a jointer-planer and adjacent portions of the base, out-feed table and cutter head in accordance with the present invention shown in section along a line generally longitudinally bisecting the in-feed table.
Figure 3:
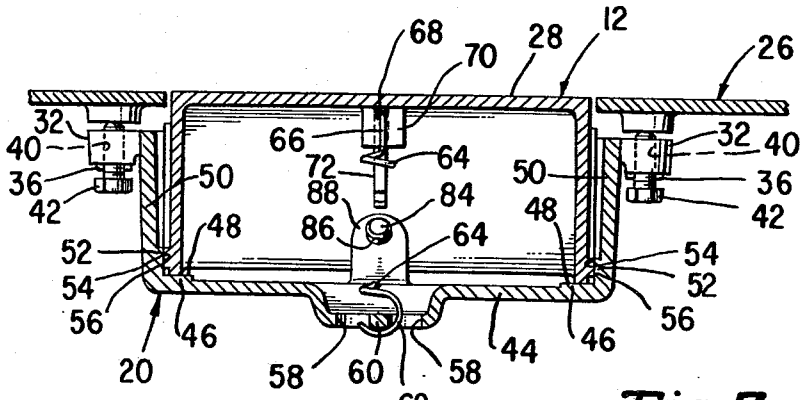
FIG. 3 is an elevational cross-sectional view taken along line 3—3 of FIG. 2.

With reference now to the drawing, there is shown and illustrated a portion of a jointer-planer designated generally by the reference character 10 which includes a generally wedge-shaped in-feed table 12 for supporting a workpiece 14 as it is fed to a generally cylindrical cutter head or assembly 16 for shaving a surface of the workpiece 14 as it is passed thereover onto an out-feed table 18. The in-feed table 12 is structurally associated with a generally wedge-shaped in-feed table support 20 and movable relative thereto in response to rotational movement of a feed or elevating screw 22 carrying a knurled knob 24 for manual rotation by the operator to adjust the height of the in-feed table 12 relative the cutter assembly or head 16 to enable depth-of-cut adjustments to be readily and easily made by such operator. The in-feed table support 20, in turn, is mounted with a support base structure 26 which also provides support mounting for the out-feed table 18, the cutter assembly or head 16 and an appropriate drive system for rotating the cutter head assembly 16 at a high speed about a generally horizontal axis generally parallel the support surface 28 of the in-feed table 12. In accordance with the present invention, the in-feed table 12 comprises a die-casting of generally wedge-shaped configuration and the in-feed table support 20 also comprises a die-casting of generally wedge-shaped configuration having integrally molded therewith a plurality, and preferably two pairs, of mounting lugs or ears 30 and 32, respectively, to enable the in-feed table support 20 to be mounted to the base structure 26 and adjusted relative thereto during assembly enabling the support surface 28 to be aligned so as to be parallel and remain parallel during adjusting movement thereof, relative the rotational axis of the cutter assembly or head 16. To achieve this, each of the mounting lugs or ears 30 and 32 is provided with a pair of holes, a mounting hole 34 providing a clearance for a mounting screw or bolt 36 which passes therethrough and engages a threaded mounting hole 38 in the base structure 26 and a threaded hole 40 through which a leveling or elevator screw 42 is passed which is not threaded into the base structure 26 but, rather, is engaged thereagainst by pressure from the mounting screws 36. In this way, without the upper surface of the in-feed table support 20 or the lower surface of the base structure 26 needing to be machined, but being suitable in an as-cast condition, the in-feed table support 20, and, in turn, the in-feed table 12 may be easily and accurately installed to provide the requisite parallelism.

Figure 4:
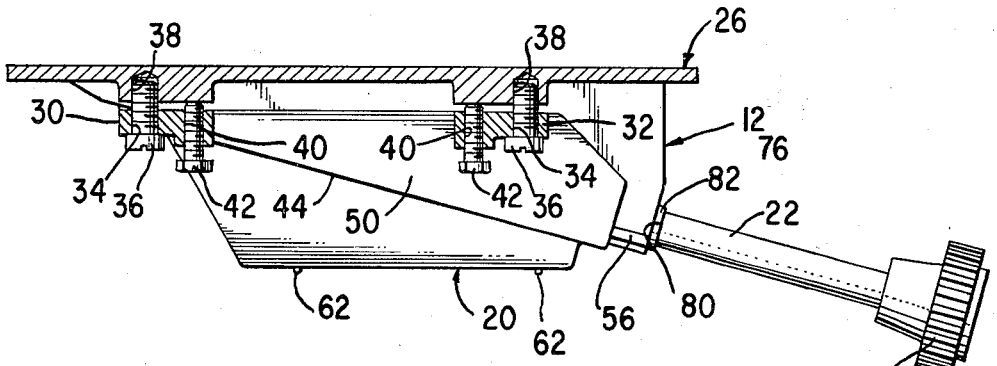
FIG. 4 is an elevational cross-sectional view taken along line 4—4 of FIG. 2.

The in-feed table support 20 further comprises a generally planer, generally rectangular base panel 44 which, as shown, (see especially FIG. 4) is inclined relative the mounting ears or lugs 30 and 32 and is provided on its inner or upper surface along the edges thereof with a pair of generally flat parallel and spaced apart lands 46, the upper surfaces of which may be machined quickly, easily, and inexpensively, to provide a pair of generally parallel, flat, inclined, spaced apart ramps or ways 48 for guidingly supporting the in-feed table 12 for vertical movement as the in-feed table 12 is moved longitudinally therealong. Extending upwardly from the planer portion 44, the in-feed table support 20 comprises a pair of generally triangular, generally parallel spaced apart side walls 50 which, adjacent the planer base panel 44, are provided with a pair of opposed inwardly facing lands 52 which are also machined on their inner surfaces to provide guiding surfaces 54 which cooperate with mating machined lands 56 provided on the sides of the in-feed table 12 to guide the in-feed table 12 against sidewise movement. The only machining required, therefore, is that of the ways, and of the work support surface 28 of the in-feed table 12.

The table support 20 is further provided with a pair of generally longitudinally centered sets of apertures 58 which define therebetween a pair of generally longitudinally spaced apart and generally laterally centered webs 60 around which the lower loops 62 of a pair of loop-ended extension coil springs 64 are hooked. These springs 64 define spring means for resiliently holding the table 12 on the table support 20. The upper loops 66 of the springs 64 are engaged with the in-feed table 12, as by being passed through apertures 68 provided in a pair of downwardly depending lugs 70 so that tension of the springs 64 hold the in-feed table 12 and the in-feed table support 20 together to define a generally rectangular block shaped assembly of variable height. The in-feed table 12 further comprises a generally central downwardly projecting rib 72 at the rearward portion thereof which, at its lower, front extremity provides a hooked beak 74. The rearward wall 76 of the in-feed table 12 is provided with a generally U-shaped slot 78 extending generally medially upwardly from the lower edge through which the elevating or height adjusting screw 22 extends. The screw 22 is provided with an annular shoulder 80 and carries a thrust washer 82 adjacent thereto for engagement with the outer surface of the rear wall 76 for selectively pushing the in-feed table 12 up the incline formed by the ways against the tension of the springs 64. The forward end portion of the screw 22 is provided with screw threads 84 which pass through a threaded hole 86 provided in a boss 88 on the rearward wall 90 of the in-feed table support 20. The boss 88 cooperates with the beak 74, as will be described hereinafter, to rtain the in-feed table 12 assembled with the in-feed table support 20 even if the elevating or height adjusting screw 22 should be inadvertently backed out of the threaded aperture 88 and also functions as a stop preventing setting of the depth-of-cut at an overly excessive depth.

Figure 5:
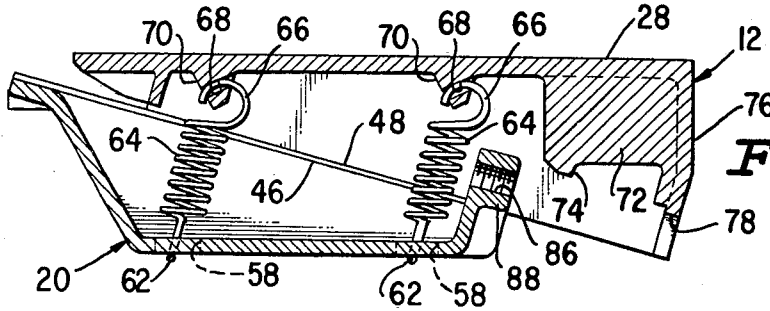
FIG. 5 is an elevational cross-sectional view of the in-feed table and table support of the preceeding figure showing a first step in the assembly thereof according to the present invention.
Figure 6:
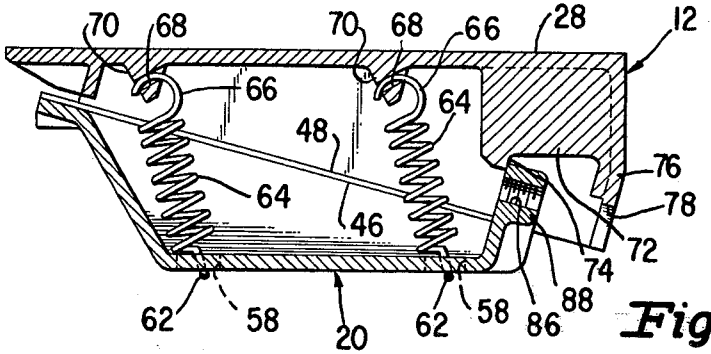
FIG. 6 is an elevational cross-sectional view similar to FIG. 5 showing a further step in the assembly thereof.
Figure 2:
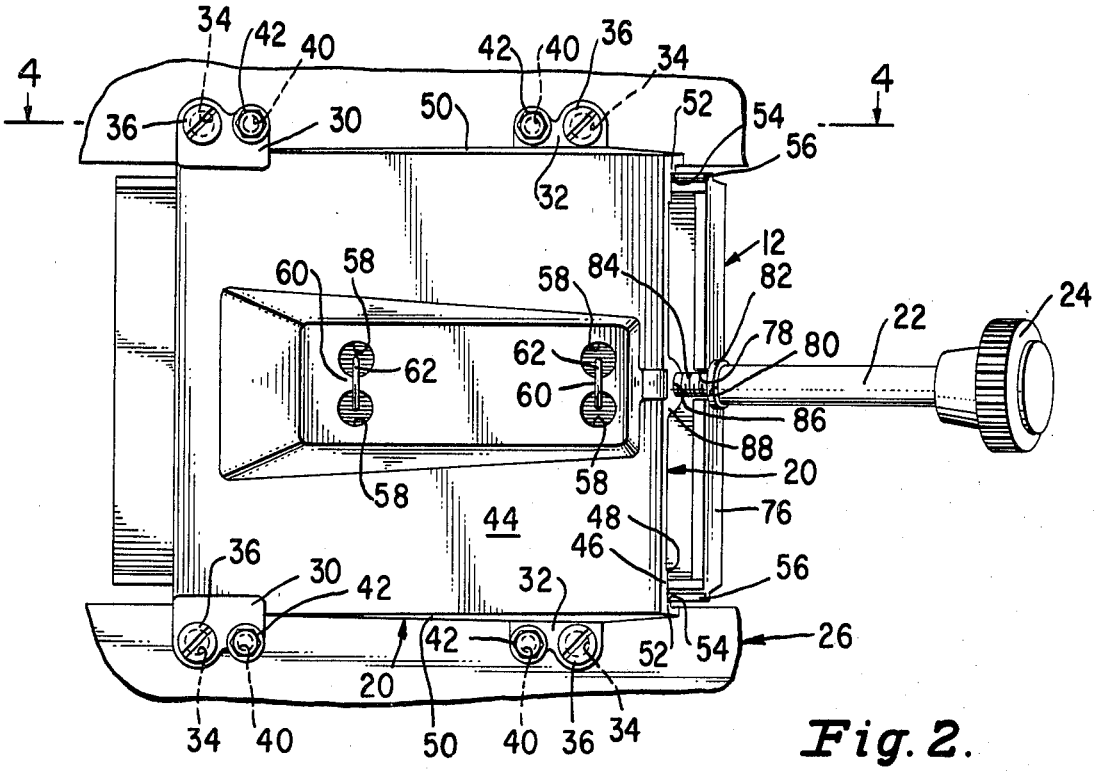
FIG. 2 is a plan view of the in-feed table of FIG. 1, viewed from below, together with a small portion of the surrounding structure.

In assembly, the springs 64 are assembled with the in-feed table 12 and the in-feed table support 20 in a relatively unstressed position, as illustrated in FIG. 5, and then the in-feed table 12 is advanced up the ramp formed by the ways until the hook beak 74 snaps past the boss 88, stretching the springs 64 to provide a preload tension thereto which maintains the in-feed table 12 in tight assembly with the in-feed table support 20. The hook beak 74 engagement against the inner surface of the boss 88 thereafter will retain the in-feed table 12 assembled with the in-feed table support 20 as shown in FIG. 6 even if the screw 22 should be removed or missing. The height adjusting screw 22 and thrust washer 82 may then be assembled therewith to complete the assembly of the in-feed table and table support sub-assembly. Then, the assembly can be attached to the base structure 26 with the mounting screws 36 and parallelism between the upper or work supporting surface 28 of the in-feed table 12 and the cutter assembly or head 16 may then be provided by proper adjustment of the levelling screws 42 while tightening of the mounting screws 36 retains the in-feed assembly in the desired position thereafter. Lock washers, antivibration insets or anaerobic adhesives such as those sold under the trademark "LOCTITE" may be utilized to assure that the parallelism is retained during the use of the machine.

While the invention has been described, disclosed, illustrated and shown in terms of certain embodiments or modifications herein described, disclosed, illustrated or shown, such other embodiments or modifications as may be suggested to those having the benefit of the teachings herein are intended to be reserved, especially as they fall within the scope and breadth of the claims here appended.

I claim:

1. In-feed table assembly for mounting on a supporting base structure of a jointer-planer having a generally cylindrical cutter assembly rotatably mounted with the supporting base structure, the assembly comprising a table support of generally wedge-shaped configuration having a pair of generally parallel triangular side wall portions and a base panel extending therebetween carrying a ramp comprising a pair of generally parallel inclined generally flat ways, a table of generally wedge-shaped configuration carried on said ways and movable therealong to therewith define a generally rectangular block-shaped assembly of variable height, spring means for resiliently holding said table on said table support, manual adjusting means for moving the said table along said ramp, and means for adjustably affixing said table support to said supporting base structure.

2. In-feed table assembly defined in claim 1 wherein said table support further comprises a rear wall and said table further comprises a depending rib defining a hook beak for cooperating therewith so that during assembly said hook beak may be moved past said rear wall to thereafter enable engagement therebetween to prevent inadvertent disassembly and retain said table and table support assembled.

3. In-feed table as defined in claim 2 wherein said adjusting means comprises a screw.

4. In-feed table assembly defined in any of claims 1, 2, or 3 with said affixing means further comprising four mounting lugs extending laterally outwardly of said table support side wall portions, each of said lugs being provided with a threaded aperture for receiving an adjustable leveling screw and an aperture adjacent thereto for a mounting bolt.

5. A jointer-planer comprising a supporting base structure, a generally cylindrical cutter assembly rotatably mounted within said supporting base structure, and an in-feed table assembly, the assembly comprising a table support of generally wedge-shaped configuration having a pair of generally parallel triangular sidewall portions and a base panel extending therebetween carrying a ramp comprising a pair of generally parallel inclined generally flat ways, a table of generally wedge shaped configuration carried on said ways and movable therealong to therewith define a generally rectangular block-shaped assembly of variable height, spring means for resiliently holding said table on said table support, manual adjusting means for moving the said table along said ramp, and means for adjustably affixing said table support to said supporting base structure.

6. Jointer-planer defined in claim 5 wherein said table support further comprises a rear wall and said table further comprises a depending rib defining a hook beak for cooperation therewith so that during assembly said hook beak may be moved past said rear wall to thereafter enable engagement therebetween to prevent inadvertent disassembly and retain said table and table support assembled.

7. Jointer-planer defined in claim 6 wherein said adjusting means comprises a screw.

8. Jointer-planer defined in any of claims 5, 6 or 7 wherein said affixing means further comprises four mounting lugs extending laterally outwardly of said table support sidewall portions, each of said lugs being provided with a threaded aperture for receiving an adjustable leveling screw and an aperture adjacent thereto for a mounting bolt.

9. Method of manufacturing an in-feed table assembly for a jointer-planer or the like comprising at least the steps of; die-casting a generally wedge-shaped in-feed table; die-casting a generally wedge shaped table support having a pair of generally parallel generally triangular side walls, a generally planar base panel extending therebetween, and an end wall; machining generally flat parallel spaced apart ways on such table and table support to provide a ramp on such table support along which such table may be moved; assembling such table and table support into a generally block like assembly of variable height; and securing such assembly together by extension coil spring means extending between such table and table support.

10. Method of adjustably mounting an in-feed table assembly as defined in claim 9 in a jointer-planer comprising providing a plurality of mounting lugs integrally molded with such table support extending outwardly thereof, providing at least two apertures in each such lug, threading at least one of such apertures in each such lug and installing an adjustable leveling screw therein, and mounting such table support with mounting bolts extending through adjacent ones of the apertures.

* * * * *